United States Patent [19]

Coone

[11] 4,183,698

[45] Jan. 15, 1980

[54] WIPER, GROUTING SEAL AND DIAPHRAGM APPARATUS

[75] Inventor: Malcolm G. Coone, Houston, Tex.

[73] Assignee: Lynes, Inc., Houston, Tex.

[21] Appl. No.: 942,527

[22] Filed: Sep. 15, 1978

[51] Int. Cl.[2] ..... E02D 5/14

[52] U.S. Cl. ..... 405/227; 405/195; 405/224

[58] Field of Search ..... 405/227, 226, 225, 224, 405/195, 208

[56] References Cited

U.S. PATENT DOCUMENTS

| | | | |
|---|---|---|---|
| 4,024,723 | 5/1977 | Mayfield et al. | 405/227 |
| 4,041,718 | 8/1977 | Stone | 405/227 |

*Primary Examiner*—Dennis L. Taylor
*Attorney, Agent, or Firm*—William C. Norvell, Jr.

[57] ABSTRACT

The present invention provides a wiper, grouting seal and diaphragm apparatus for use on a tubular sleeve of a structure wherein the sleeve receives a piling. The apparatus has a housing with a bore therethrough. A manifold seal extends interior of and circumferentially around the housing. Fluid receiving means are provided for communication with a pressure conduit extendable from the manifold to the structure. Fluid ejecting means are defined on the manifold for selective discharge of fluid injectable through the conduit and the manifold and interior of the sleeve. A longitudinally shiftable cage member initially defines the interior wall of the housing and has means engageable by the lower end of the piling for shifting of the cage member whereby the manifold is urged away from the housing and against the piling. Diaphragm seal means are initially held by the housing and across the bore, the seal means being rupturable by the cage member upon shifting of the cage member by the piling. In an alternative embodiment, the cage member is replaced by securing means which are circumferentially extendable exteriorally around the diaphragm sealing means for initially positioning the manifold within the housing and substantially out of the bore of the housing when the manifold is in retracted position and permitting the manifold to effectively expand into the bore upon rupture of the seal means, the relative position of the manifold and the securing means providing effective sealing engagement of the seal means and the manifold.

19 Claims, 7 Drawing Figures

WIPER, GROUTING SEAL AND DIAPHRAGM APPARATUS

BACKGROUND OF THE INVENTION

1. Field of the Invention

The invention relates to a combination wiper, grouting seal and diaphragm apparatus for use on a tubular sleeve of a structure, such as the leg of an offshore platform utilized in the drilling and completion of subterranean offshore oil and gas wells.

2. Description of the Prior Art

Platforms for utilization of the drilling of offshore subterranean oil and gas wells have a plurality of piling sleeves or guides which are utilized to secure the platform in place by insertion therethrough of a piling which has open ends. Oftentimes, due to the large mass and extreme weight of the structure, it is desirable to float it from an inland location to its offshore location where it is thereafter sunk and secured. In order to provide effective means for floating of the platform to the offshore location, it is desirable to sealingly secure the lower ends of the sleeves whereby the sleeves act as buoys for flotation purposes. Additionally, and even when such platforms, or portions thereof, are not floated from the inland to offshore location, and because the annulus between the piling and the sleeve receiving the piling usually will be filled with cement or grout, it is highly desirable to eliminate as much foreign particulate matter as possible. In the past, those skilled in the art have attempted to resolve this problem by enclosing the lower end of the sleeve by utilizing fastening metal plates or the like or by mounting caps on the lower ends or simply by securing wipers to the internal surfaces thereof. Although such metal plates and caps somewhat provide the buoyancy necessary for economical floatation of the platforms to the offshore location, the plates or caps must be securely fit to the sleeves. Accordingly, they will oftentimes become quite difficult to displace or knock out by the driving pile, resulting in the wipers being torn out of the sleeve by the piling. Additionally, many such plates or caps have to be removed by utilization of a diver and other costly diving equipment.

The prior art has also disclosed through U.S. Pat. No. 3,533,241, entitled "Rupturable Seal Assembly For Piling Guides", Bill H. Bowerman, et al, Inventors, a rupturable seal assembly. However, this apparatus must incorporate separate diaphragm and pile wiping means and does not incorporate, in combination, a wiper element permitting grouting to be ejected therethrough, subsequent to the rupturing of the diaphragm.

The present invention remedies the problems found in the practices of the prior art by providing, in combination, a wiper, grouting seal and diaphragm apparatus of simple construction, which enables immediate grouting of the annulus between the sleeve and the piling through the wiper subsequent to the rupture of the diaphragm by the insertion of the piling therethrough and within the sleeve.

SUMMARY OF THE INVENTION

This invention provides a combination wiper, grouting seal and diaphragm apparatus which is utilized on a tubular sleeve of a structure, such as an offshore drilling platform, wherein the sleeve receives a piling therethrough for anchoring of the platform to the ocean bed. The apparatus has a housing with a bore therethrough.

An elastomeric manifold seal extends interiorally within and circumferentially around the housing. Fluid receiving means are defined through the manifold for communication with a pressure conduit which is extendable from the manifold to the platform. Fluid ejecting means are provided through the manifold for selective discharge of fluid injectable through the conduit and the manifold and interior of the piling sleeve. A longitudinally shiftable cage member initially defines the interior wall of the housing. Means on the cage member are engageable by the lower end of the piling and are insertable within the sleeve for longitudinally shifting of the cage member whereby the manifold may be urged away from the housing and against the piling. Diaphragm seal means are initially held by the housing and defined across the bore, the seal means being rupturable by the cage member upon longitudinal shifting of the cage member by the piling.

An alternative embodiment of the present invention substitutes for the longitudinally shiftable cage member, securing means which are circumferentially extendable exteriorally around the diaphragm sealing means and are initially positioning the manifold within the housing and substantially out of the bore of the housing when the manifold is in the retracted position, thus permitting the manifold to effectively expand into the bore upon rupture of the diaphragm seal means, with the relative position of the manifold and the securing means providing effective sealing engagement of the seal means and the manifold.

The invention is readily adaptable for use in particularly harsh environments inasmuch as the elastomeric manifold is non-inflatable, thus not requiring an auxiliary or second conduit for otherwise inflating a manifold. Thus, when the invention is utilized, a single conduit may be incorporated to both extend the manifold and to perform the grouting operation.

DESCRIPTION OF THE PREFERRED EMBODIMENTS

Figure 1:
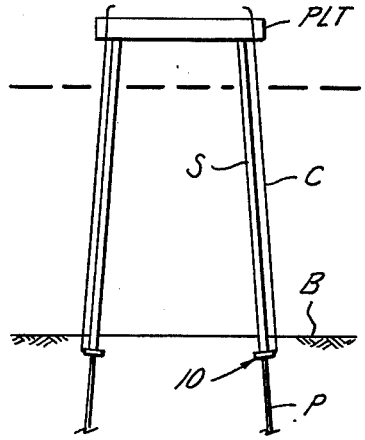
FIG. 1 is a schematic illustration of a platform located on a sea bed with a plurality of piling sleeves being disposed between the sea bed and the top of the platform structure, each sleeve carrying thereon the present apparatus.

Referring now to FIG. 1, the apparatus 10 is shown disposed immediate the lower end of a sleeve S forming a leg of a platform PLT disposed upon the sea bed B for the drilling or completion of an offshore oil or gas well.

Figure 2:
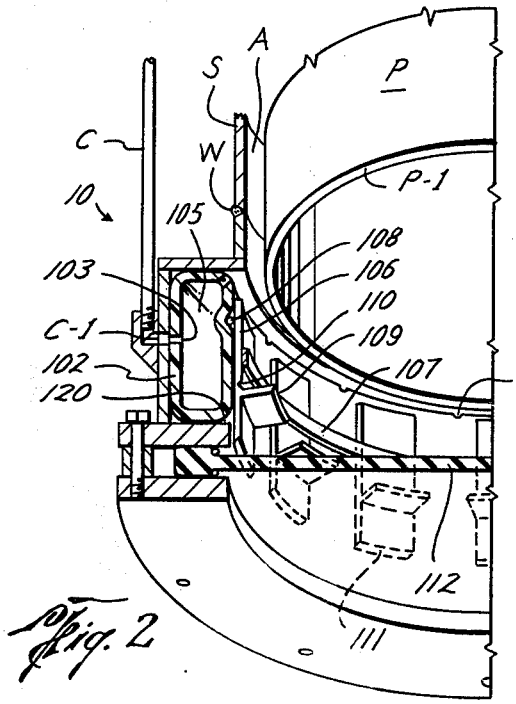
FIG. 2 is a perspective sectional view through a tubular sleeve with a piling being inserted therethrough, the view illustrating a diaphragm enclosing the lower end of the sleeve, and the piling being positioned prior to contact with the cage member of the housing.

Now referring to FIGS. 2 and 3, the apparatus 10 is illustrated as being affixed by weld W to the lower end of a sleeve S, an annular area A to be subsequently grouted being defined between the internal diameter of the sleeve S and the external diameter of a piling P having a lower end P-1, the piling P being subsequently inserted through the interior of the sleeve S.

The apparatus 10 consists of a circumferentially extending cylindrical housing 100 having an upper face 100*a*, the housing 100 having a bore therethrough for insertion of a piling P. The apparatus 10 receives through the housing 100 a conduit C which extends upwardly to the platform for insertion therethrough of pressurized grout or other fluid for transmission through a manifold 102 housed inwardly of the housing 100. An opening C-1 is disposed at the lowermost end of the conduit C for companion communication with a portal 103 defined transversely through the manifold 102 and communicating with the interior 105 of the manifold 102. The manifold 102 is held inwardly of the bore of the housing 100 by means of a longitudinally shiftable cage element 106, the cage 106 having an inwardly circumferentially disposed ring element 108 immediate its uppermost end and exteriorally disposed toward the manifold 102. The manifold 102 is of conventional construction, is elastomeric in nature, and may have steel stripped or fabric reinforcing elements defined interiorally therein.

The manifold 102 also defines at its uppermost end a plurality of portals 104 which are normally isolated, but not necessarily, from fluid communication between the interior 105 of the manifold 102 and the annulus A between the piling P and the sleeve S by means of sealing engagement upon the upper face 100*a* of the housing 100. Alternatively, the portals 104 may have insertable therethrough a plugging element or means (not shown) which is easily pressurely ejected therefrom or ruptured upon the selective increase of fluid pressure within the Conduit C.

The cage 106 has an inwardly facing "v" cut 110 therein which permits ready bending of the cage 106 as the lower end P-1 of the piling P passes thereacross. The cage 106 is secured to or urged against the housing 100 by means of an internal circumferentially extending band 107. Below the band 107 is an inwardly protruding shoulder element 109 for receipt of the lower end P-1 of the piling P when it is desired to longitudinally shift the piling P downwardly of the apparatus 10 to rupture a diaphragm 112 therebelow and allow the manifold 102 to expand for pile wiping and annulus grouting purposes. The cage 106 has a bevelled comparatively sharp end 111 which, when the lower end of P-1 of the piling P contacts and engages the shoulder 109 as the piling P is passed through the sleeve S, penetrates into and through the diaphragm 112 therebelow to break the sealing integrity of the diaphragm 112.

The diaphragm 112 is secured across the bore of the housing 100 and is secured to the housing 100 by means of upper and lower flanges F-1 and F-2, respectively, the flanges being secured one to another by means of bolts 114 being circumferentially extended in spaced relationship therethrough, the upper flange F-1 having an upwardly facing shoulder area 120 for resisting downward longitudinal travel of the ring 108.

Figure 3:
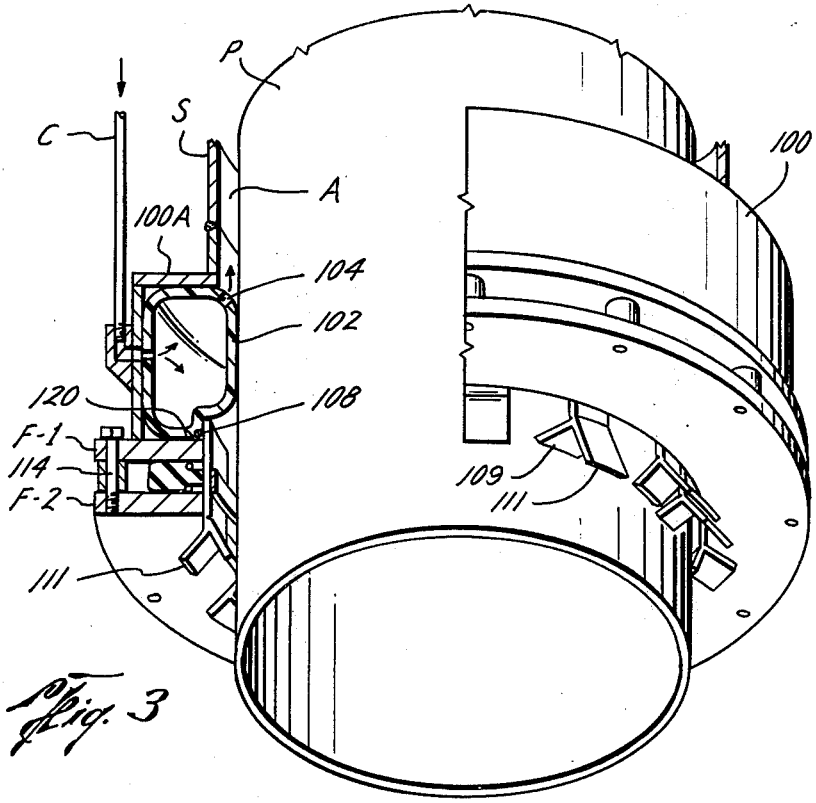
FIG. 3 is a view similar to that illustrated in FIG. 2, with the diaphragm being ruptured by penetration therethrough of the piling and the cage member being shifted to permit the manifold to expand within the interior of the sleeve, with fluid grout being injected into and ejected out of the manifold for sealing of the annulus between the piling and the sleeve thereabove.

Now referring to FIG. 3, when it is desired to anchor the platform PLT upon the sea bed B, a piling P is inserted through each of the sleeves S, the apparatus 10 being prior thereto affixed to the lower end of the sleeve S by means of weld W, the diaphragm 112 preventing fluid ingress to the interior of the sleeve S. As the piling P approaches the apparatus 10, the lower end P-1 of the piling P will engage the inwardly protruding shoulder 109 of the cage 106. As the lower longitudinal travel of the piling P continues within the sleeve S, the plurality of circumferentially inwardly extending shoulders 109 transmits the lower longitudinal force caused by lower travel of the piling P across the cage 106 whereby the securing force afforded by the ring 108 is overcome and the cage 106 travels lowerly together with the piling P until such time as the ring 108 is caused to rest upon the shoulder 120 of the flange F-1. When the shoulder 120 is interfaced with the ring 108, further lower longitudinal travel of the cage 106 is prevented. Concurrently with the lower travel of the cage 106, the manifold 102 has been permitted to expand within the interior bore of the housing 100, thus exposing the portal 104 to the annulus A between the piling P and the sleeve S, assuming that the portal 104 initially is plugged. As the piling P is moved downwardly carrying the cage 106, the inner exterior surface of the manifold 102 will seal against the piling P and the piling P will be permitted to slidingly shift therethrough.

Together with the expansion of the manifold 102, and subsequent to the interface between the ring 108 and the shoulder 120, further lower longitudinal travel of the cage 106 is prevented. Accordingly, and since the piling P will continue further lower longitudinal travel, the shoulders 109 will flex outwardly of the bore of the housing 100 shortly after passage across the lower end of the lower flange F-1, thus permitting continued free travel of the piling P therebelow, due the undercut afforded by the "v" cut 110.

Thus, as illustrated in FIG. 3, the piling P has caused the cage 106 of the housing 100 to be shifted downwardly, thus permitting the manifold 102 to enter into the bore 100 of the housing, as well as permitting the bevelled end 111 of the cage 106 to shear and rupture the diaphragm 112. Now, the manifold 102 is enabled to act as a combination grouting manifold as well as a wiper element for wiping debris from the exterior of the piling P as it passes adjacent thereto. Additionally, the manifold 102, in sealing position around the exterior of the piling P prevents water, silt, sand and other particulate matter and debris from passing into the annulus A of the housing 100 above the apparatus 10, to assure a more effective grouting of the annulus A between the piling P and the sleeve S.

When the piling P is subsequently inserted through the sea bed B to the preselectable position, grout and pressure are applied through the conduit C and pass through the opening C to the interior 105 of the manifold 102 by means of the passageway or portal 103 in the manifold 102. The grout passes through the interior 105 of the manifold 102 by means of the open port or passageway 104, thence to the annulus A between the piling P and the sleeve S. Not only is the annulus A permitted to be grouted through the manifold 102 but, the manifold 102 defining a hollow interior 105 therein, the manifold 102 itself is permitted to hold grout to assure a firm sealing engagement against the piling P. Utilization of a plurality of ports 104 circumferentially extending around the uppermost inner daimeter of the manifold 102 assures a more uniform placement of the grouting material around the piling P from the bottom to the top.

It should be noted that when the grouting procedure is conducted through the conduit C, back pressure inside the manifold 102 during the grouting process will enhance its sealing capability. Once the grouting procedure is completed, the static head of grout inside the manifold 102 will exert a sealing force against the piling P in excess of the force attempting to bypass the manifold 102, thus assuring a positive sealing across the piling P under any differential static head condition.

Figure 4:
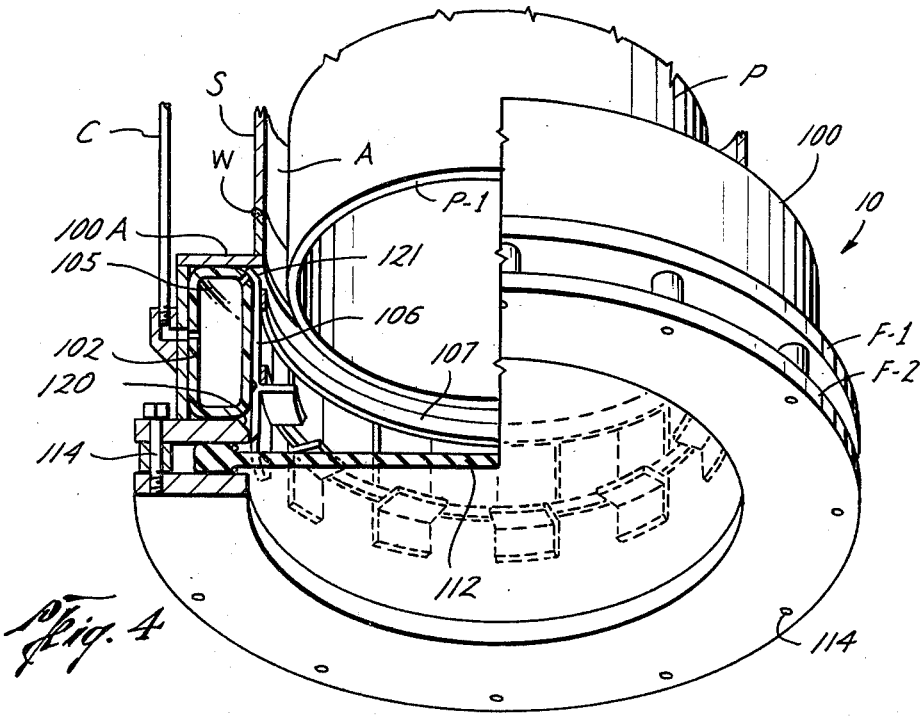
FIG. 4 is a view similar to that illustrated in FIG. 2, showing a somewhat varied configuration for the cage member.
Figure 5:
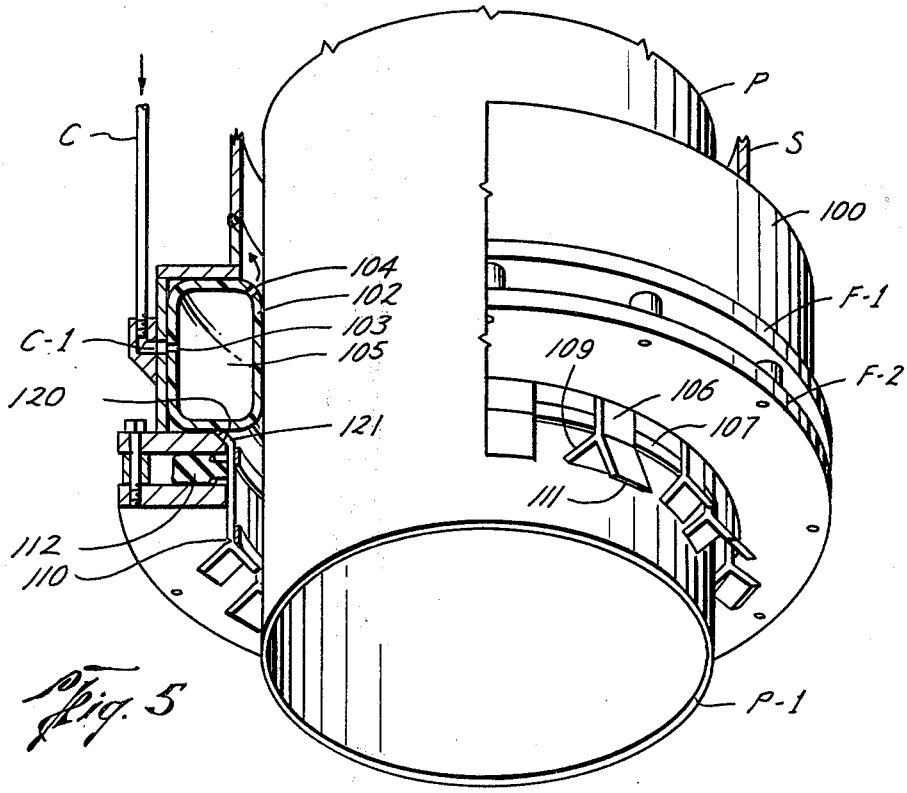
FIG. 5 is a view similar to that shown in FIG. 4 with the modified cage member being shifted downwardly from the manifold by insertion through the sleeve of the piling element.

Now referring to FIGS. 4 and 5, illustrating an alternative embodiment of the present invention, a shoulder 109 is defined on the cage 106. Additionally, the cage 106 has an outwardly bevelled upper end 121 extending toward the manifold 102. As the lower end P-1 of the piling P contacts and engages the shoulder 109, the cage 106 is permitted to shift downwardly until such time as the upper end 121 contacts a companion bevelled shoulder 120 on the flange F-1 of the housing 100, and the shoulder 109 will flex downwardly, somewhat, as lower longitudinal travel of the piling P through the sleeve S is continued. In this modified version, the manifold 102 is permitted to thereafter enter into the bore of the housing 100 and the grouting procedure through the conduit C is conducted, as in FIG. 3.

Figure 6:
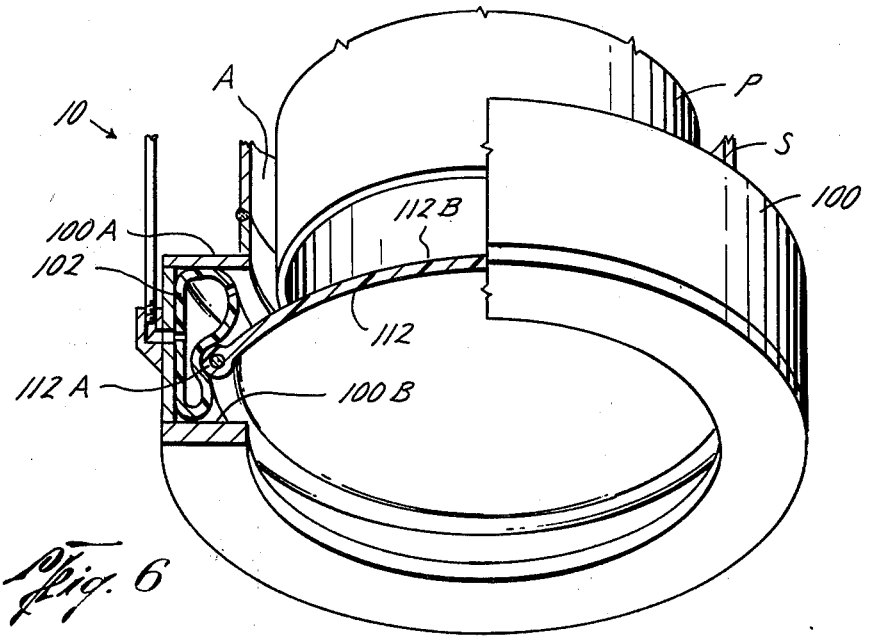
FIG. 6 is a partial cross-sectional view of an alternative embodiment of the present invention prior to a piling inserted through the sleeve being shifted downwardly for engagement with the diaphragm and expansion of the manifold.
Figure 7:
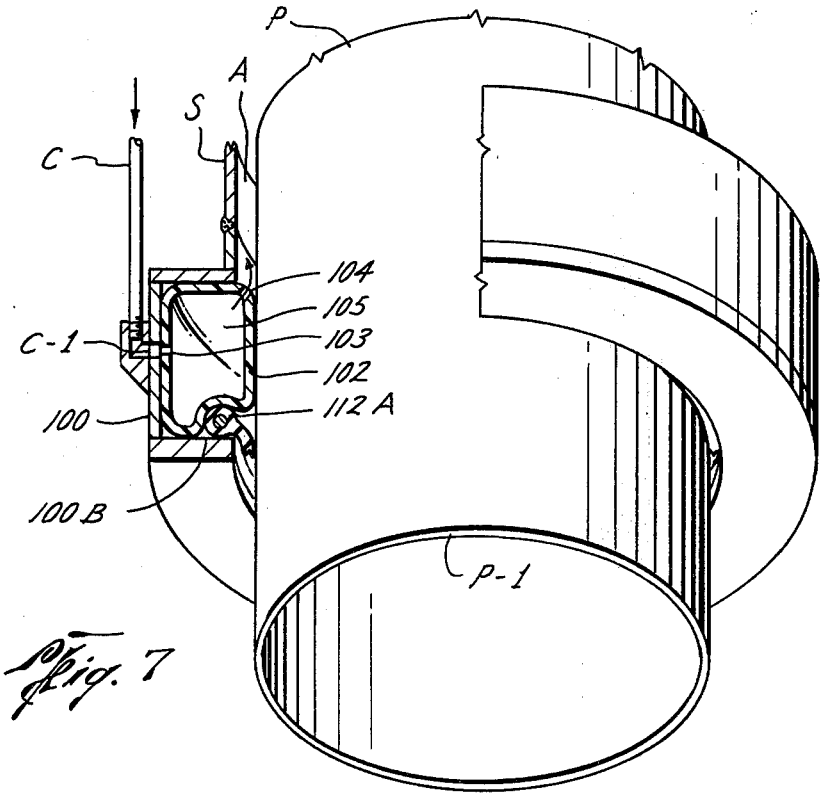
FIG. 7 is a partial cross-sectional view similar to that illustrated in FIG. 6, particularizing the diaphragm being ruptured by the piling inserted through the sleeve and downward of the manifold and the diaphragm, with the manifold in expanded position partially within the interior of the sleeve, and fluid grout being injected through the manifold and thereabove for grouting of the annulus between the piling and the sleeve.

Now referring to yet another alternative embodiment of the present invention, as shown in FIGS. 6 and 7, a dome shaped diaphragm 112 is initially held against the inner wall of the manifold 102 to urge the manifold into contracted position within the housing 100 by means of a securing band **112*a* formed around the exterior of the domed diaphragm 112 and engaging the manifold 102. The securing band 112*a* is shown as circular in configuration and defined circumferentially around the exterior of the domed diaphragm 112, but the securing band 112*a* may be of any geometric configuration sufficient to interface between the manifold 102 and the domed diaphragm 112 to secure the diaphragm 112 to the manifold 102 and contract the manifold 102 out of the bore of the housing 100, to permit initial free travel of the piling P thereabove and to the upper face 112*b* of the domed diaphragm 112**.

Referring now to FIG. 6, and 7, the lower end P-1 of the piling P contacts and engages the upper face **112*b* of the domed diaphragm 112, shifting the diaphragm 112 and the securing means 112*a* downwardly until such time as the securing means rests upon the lower shoulder 100*b* of the housing 100. Thereafter, the piling P continues to shift longitudinally downwardly and rupture the diaphragm 112, thus enabling the manifold 102 to expand inwardly and within the bore of the housing 100 with the shoulder 100*b* holding the band 112*a* in place to permit the torn diaphragm to wipe the exterior of the piling P. Thereafter, the grouting procedure as described above and as shown in FIG. 2** is conducted.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A combination wiper, grouting seal and diaphragm apparatus for use on a tubular sleeve of a structure, a piling being receivable through said sleeve, said apparatus comprising: a cylindrical housing defining a bore therethrough; an elastomeric manifold seal extending interiorally within and circumferentially around said housing; fluid receiving means through said manifold for communication with a pressure conduit extendable from said manifold to said structure; fluid ejecting means through said manifold for selective discharge of fluid injectable through said conduit and said manifold and interior of said sleeve; a longitudinally shiftable cage member initially defining the interior wall of said housing; means on said cage member engageable by the lower end of said piling insertable within said sleeve for longitudinally shifting said cage member whereby said manifold may be urged away from said housing and against said piling; and diaphragm seal means initially held by said housing and defined across said bore, said seal means being rupturable by said cage member upon longitudinal shifting of said cage member by said piling to wipe the exterior of said piling.

2. The apparatus of claim 1 wherein said fluid ejecting means comprises at least one fluid discharge means defined within said manifold.

3. The apparatus of claim 1 wherein said fluid ejecting means comprises at least one fluid discharge means defined within said manifold, and plugging means initially disposed within said fluid discharge means and selectively removable therefrom.

4. The apparatus of claim 3 wherein said plug means initially disposed within said fluid discharge means is selectively removable therefrom upon application of pressure interior of said manifold.

5. The apparatus of claim 3 wherein said plug means initially disposed within said fluid discharge means is selectively removable therefrom upon longitudinal shifting of said cage member.

6. The apparatus of claim 3 wherein said plug means initially disposed within said fluid discharge means is selectively opened upon longitudinal shifting of said cage member.

7. In an apparatus defining a wiper, grouting seal and diaphragm for use on a tubular sleeve of a structure, a piling being receivable through said sleeve, the improvement comprising: a cylindrical housing defining a bore therethrough; an elastomeric manifold seal extending interiorally within and circumferentially around said housing; fluid receiving means through said manifold for communication with a pressure conduit extendable from said manifold to said structure; fluid ejecting means through said manifold for selective discharge of fluid injectable through said conduit and said manifold and interior of said sleeve; a longitudinally shiftable cage member initially defining the interior wall of said housing; and means on said cage member engageable by the lower end of said piling insertable within said sleeve for longitudinally shifting said cage member whereby said manifold may be urged away from said housing and against said piling.

8. The apparatus of claim 7 wherein said fluid ejecting means comprises at least one fluid dischargeable means defined within said manifold.

9. The apparatus of claim 7 wherein said fluid ejecting means comprises at least one fluid discharge means defined within said manifold and plugging means initially disposed within said fluid discharge means and selectively removable therefrom.

10. The apparatus of claim 7 wherein said plug means initially disposed within said fluid discharge means is selectively removable therefrom upon application of pressure interior of said manifold.

11. The apparatus of claim 7 wherein said plug means initially disposed within said fluid discharge means is selectively opened upon application of pressure interior of said manifold.

12. The apparatus of claim 7 wherein said plug means initially disposed within said fluid discharge means is selectively removable therefrom upon longitudinal shifting of said cage member.

13. The apparatus of claim 7 wherein said plug means initially disposed within said fluid discharge means is selectively opened upon longitudinal shifting of said cage member.

14. A combination wiper, grouting seal and diaphragm apparatus for use on a tubular sleeve of a structure, a piling being receivable through said sleeve, said apparatus comprising: a cylindrical housing defining a bore therethrough; a normally retracted, expandable elastomeric manifold seal extending interiorally within and circumferentially around said housing; fluid receiving means through said manifold for communication with a pressure conduit extendable from said manifold to said structure; fluid ejecting means through said manifold for selective discharge of fluid injectable through said conduit and said manifold and interior of said sleeve; diaphragm seal means initially held by said housing and defined across said bore, said seal means being rupturable by said piling upon longitudinal shifting of said piling in said sleeve; and securing means circumferentially extending exteriorally around said sealing means and initially positioning said manifold within said housing and substantially out of the bore of said housing when said manifold is in retracted position and permitting said manifold to effectively expand into said bore upon rupture of said seal means, the relative position of said manifold and said securing means providing effective sealing engagement of said seal means and said manifold.

15. In an apparatus defining a combination wiper and grouting seal for use on a tubular sleeve of a structure, a piling being receivable through said sleeve, the improvement comprising: a cylindrical housing defining a bore therethrough; an elastomeric manifold seal extending interiorally within and circumferentially around said housing; fluid receiving means through said manifold for communication with a pressure conduit extendable from said manifold to said structure; fluid ejecting means through said manifold for selective discharge of fluid injectable through said conduit and said manifold and interior of said sleeve; a longitudinally shiftable cage member initially defining the interior wall of said housing; and means on said cage member engageable by the lower end of said piling insertable within said sleeve for longitudinally shifting said cage member whereby said manifold may be urged away from said housing and against said piling.

16. The apparatus of claim 15 wherein said fluid ejecting means comprises at least one fluid dischargeable means defined within said housing.

17. The apparatus of claim 15 wherein said fluid ejecting means comprises at least one fluid discharge means defined within said manifold and plugging means initially disposed within said fluid discharge means and selectively removable therefrom.

18. The apparatus of claim 15 wherein said plug means initially disposed within said fluid discharge means is selectively removable therefrom upon application of pressure interior of said manifold.

19. The apparatus of claim 15 wherein said plug means initially disposed within said fluid discharge means is selectively removable upon application of pressure interior of said manifold.

* * * * *